United States Patent [19]

Dilmore et al.

[11] Patent Number: 4,767,323

[45] Date of Patent: Aug. 30, 1988

[54] LIME KILN AND METHOD OF RETARDING FORMATION OF SLAG RING THEREIN

[75] Inventors: James A. Dilmore, Irwin; William E. Young, Churchill Boro; Wesley M. Rohrer, Jr., Pittsburgh; Abner B. Turner, Hempfield Township, Westmoreland County, all of Pa.

[73] Assignee: Westinghouse Electric Corp., Pittsburgh, Pa.

[21] Appl. No.: 64,722

[22] Filed: Jun. 22, 1987

[51] Int. Cl.[4] ..... F27B 7/38

[52] U.S. Cl. ..... 432/116; 110/246; 432/111

[58] Field of Search ..... 110/246, 255, 257, 258, 110/347, 229, 230, 233, 234, 203, 208, 210, 215, 301, 302, 306, 150, 157, 260, 261; 432/103, 105, 108, 111, 116

[56] References Cited

U.S. PATENT DOCUMENTS

| | | | |
|---|---|---|---|
| 3,242,888 | 3/1966 | Klovers et al. . | |
| 3,412,697 | 11/1968 | Matteini . | |
| 3,584,609 | 6/1971 | Lerner et al. | 110/246 |
| 3,682,453 | 8/1972 | Powell | 432/116 |
| 3,751,220 | 8/1973 | Rossi | 432/116 X |
| 3,763,830 | 10/1973 | Robinson et al. | 122/4 D |
| 3,822,651 | 7/1974 | Harris et al. | 110/246 X |
| 3,938,450 | 2/1976 | Jaronko et al. . | |
| 4,529,081 | 3/1981 | Reuter et al. | 432/105 X |
| 4,543,061 | 9/1985 | Edwards | 432/116 X |
| 4,580,504 | 4/1986 | Beardmore et al. | 110/234 X |
| 4,671,192 | 6/1987 | Hoffert et al. | 110/214 X |

*Primary Examiner*—Steven E. Warner

[57] ABSTRACT

An apparatus and method for retarding the formation of a slag ring on the inner wall of a rotary lime kiln where coal combustion gases are used to provide heat in the calcining chamber of a rotary lime kiln. The inner wall of the kiln, at a predetermined location where a slag ring would tend to form, is cooled so as to cool the dispersed slag prior to contact with the inner wall of the calcining chamber sufficiently to prevent adherence of the slag to the inner wall. Cooling chambers or a cooling channel may be provided in the refractory lining forming the inner wall, or transpiration devices may be provided to inject coolant into the calcining chamber, at the predetermined location, to cool the slag and prevent adherence thereof to the inner wall.

26 Claims, 4 Drawing Sheets

LIME KILN AND METHOD OF RETARDING FORMATION OF SLAG RING THEREIN

REFERENCE TO RELATED APPLICATION

Reference is made to a related application entitled "Method and Apparatus for Calcining Limestone Using Coal Combustion for Heating", filed June 22, 1987 as Ser. No. 064,723, in the names of J. A. Dilmore, S. Y. Lee, W. E. Young and W. M. Rohrer, assigned to the assignee of the present invention.

FIELD OF THE INVENTION

The present invention relates to a rotary lime kiln designed to prevent formation of a slag ring in the calcining chamber of the kiln and a method for prevention of the formation of a slag ring in a rotary lime kiln.

BACKGROUND OF THE INVENTION

In the production of lime from limestone, the limestone is heated in a calcining chamber so as to decompose the same and drive off carbon dioxide according to the general equation:

$$CaCO_3 + Heat \rightarrow CaO + CO_2$$

with heating of the limestone to a high temperature and holding it at that temperature for a period of time to effect the decomposition. This calcination, or "burning", requires a large amount of heat.

The limestone can be calcined in a shaft kiln or a rotary kiln. A rotary kiln generally comprises a long straight tubular steel shell that is lined on the inside with refractory brick. The tubular shell is usually inclined at an angle of about 3° to 5° to the horizontal and rests on trunions which rotate the tubular shell at about 1 to 2 revolutions per minute. A charge of limestone is fed into the upper end into the top of the kiln into a calcining chamber and slowly travels in a tumbling fashion through the length of the kiln. Heat is supplied into the lower end of the kiln through use of a burner that projects a flame into the calcining chamber between the charge passing through the calcining chamber and the refractory lining of the kiln. Oil, natural gas, or pulverized coal can be combusted in the kiln to provide the necessary heat, with heat transfer to the charge mainly achieved by radiation and conduction.

Because of the favorable price differential of coal over natural gas as a fuel, many calcining kilns in the United States have been switched from natural gas to pulverized coal firing. The problems associated with such a switch involve not only the additional capital costs and maintenance costs of coal handling and pulverizing equipment, but the fact that the molten slag, or ash, from the coal leaving the flame front deposits on the walls of the calcining chamber of the kiln and builds up a hard glassy fused-slag ring about the wall of the calcining chamber. This build-up eventually plugs the kiln, and has to be periodically removed. In some installations, kiln production is being lost for periods of several days, every ninety days of operation.

The slag ring problem is theoretically manageable. Calcining temperatures, in the vicinity of 1700° F., are below the ash fusion temperatures of most United States coals. If, in fact, calcining proceeded at or slightly below the minimum ash fusion temperatures the fly ash from the coal would not become a liquid slag and therefore would not stick to the kiln walls. However because of the poor heat transfer characteristics of the non-uniform limestone bed, the kilns are overfired and temperatures are permitted to rise far above the molten slag forming temperature. The resultant slag ring problem is evidently considered preferable to the incomplete calcining that would result from lower firing rates using conventional kiln lengths.

More vigorous mixing of the limestone bed would expose more of the material to the radiant flame front and would therefore allow a reduction in firing rate for the same calcining efficiency. However this would also result in the creation of more lime fines which is the major air pollutant from the kilns.

It is an object of the present invention to provide an improved lime kiln that is designed to retard the formation of a slag ring on the walls of the calcining chamber when coal is combusted to provide heat for calcination of lime passing through the calcining chamber.

It is another object of the present invention to provide a method for retarding the formation of a slag ring on the inner wall of a rotary lime kiln, during calcination of lime in a calcining chamber of the kiln.

SUMMARY OF THE INVENTION

A rotary lime kiln for the calcination of limestone to form lime, wherein a coal combustion chamber is used to produce hot combustion gases for calcination of the limestone, and wherein dispersed molten slag is carried along with the hot combustion gases into the calcining chamber, has a means thereon for cooling the inner wall of the kiln at a predetermined location, where the molten slag would tend to contact the wall and effect formation of a slag ring.

The means for cooling the inner wall can be a radially inwardly extending wall section, or a plurality of spaced, diametrical wall sections which extend into the inner refractory lining about the kiln, with inlets and outlets for passage of a coolant through the inwardly directed wall sections. The inwardly directed wall sections preferably comprise inner and outer walls and side walls which form a cooling chamber therebetween. Or, only inner and side wall sections may be provided which form a cooling channel about the inner wall, with a coolant directed into the cooling channel.

In other embodiments of the present line kiln, the kiln may contain an inlet conduit which is coaxially positioned within the calcining chamber, and extends either through the lower or upper end wall of the kiln, with radially outwardly extending branch conduits carrying coolant from the inlet conduit to wall section conduits in the inner wall of the kiln, to cool the same, with radially outwardly extending conduits leading therefrom to an outlet conduit which discharges the coolant therefrom. The coolant discharge from the discharge conduit may be outside the rotary kiln, or it may be inside the kiln into the spent hot combustion gases adjacent the discharge for the combustion gases from the kiln.

In a further embodiment of the invention, transpiration devices, such as porous cermic forms, or blocks, may replace a section of the refractory lining of the kiln and means provided for injecting a coolant fluid through porous surfaces of the form facing the calcining chamber, into the chamber. Conduits for providing the coolant fluid to the transpiration devices comprise an inlet conduit coaxial with the kiln which may extend through either the upper or lower end wall of the kiln, and radially outwardly extending branch conduits communicating between the inlet conduit and the transpiration devices.

DETAILED DESCRIPTION

Figure 1:
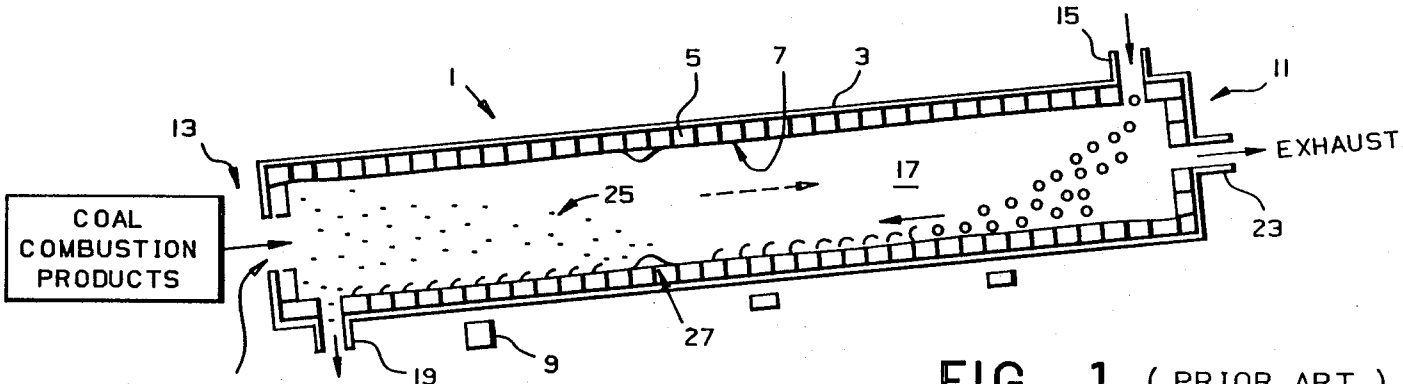
FIG. 1. (PRIOR ART)
FIG. 1 is a sectional view, along the longitudinal axis, through a conventional rotary lime kiln showing the inner wall thereof and the formation of a slag ring which results from combustion of coal to provide heat to the calcining chamber.

As illustrated in FIG. 1, a conventional lime kiln 1 is comprised of a cylindrical vessel 3 that has a refractory lining 5 forming an inner wall 7, the vessel being rotated about its axis such as by rollers 9 which are activated by a power source (not shown). The cylindrical vessel 3 is inclined slightly to the horizontal so as to provide an upper end wall 11 and lower end wall 13. An inlet 15 is provided adjacent the upper end 11 for the introduction, into the enclosed calcining chamber 17 of the vessel, of limestone that is to be calcined to produce lime. The limestone travels from the region adjacent the upper end 11 of the vessel to a location adjacent the lower end 13 of the vessel, decomposing to lime during said travel, and the lime produced is discharged through an outlet 19.

In order to decompose the limestone to form lime, heat is applied to the interior or enclosed calcining chamber 17 of the vessel. As illustrated, coal combustion products, comprising hot combustion gases and molten slag, in dispersed molten form, are charged through a combustion gas inlet 21 at the lower end 13 of the vessel. The hot combustion gases flow through the vessel 3 countercurrent to the travel of the limestone and lime product, and are exhausted from the vessel through a gas exhaust outlet 23 at the upper end 11 of the vessel 3. The dispersed molten slag 25 is carried by the hot combustion gases into the calcining chamber 17 of the vessel and tends to deposit out from the gaseous stream onto the inner wall 7, as indicated at 27, as a slag ring.

Figure 2:
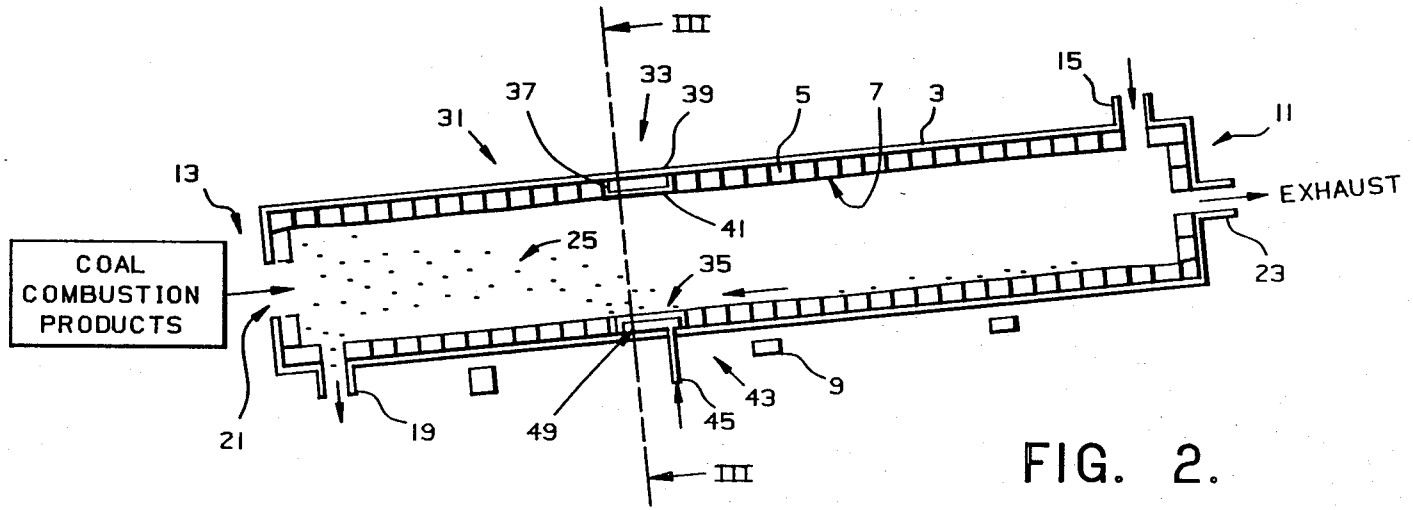
FIG. 2 is a sectional view, similar to FIG. 1, showing an embodiment of the lime kiln of the present invention wherein a cooling chamber is provided in the inner wall of the rotary vessel, which cooling chamber extends about the rotary vessel.
Figure 3:
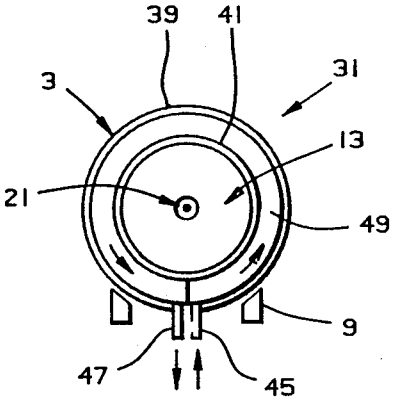
FIG. 3 is a view taken along the lines III—III of FIG. 2.

An embodiment of a lime kiln that is adapted to carry out the present process is illustrated in FIGS. 2 and 3, wherein components that are comparable to conventional lime kilns are labeled with the same numerals as in FIG. 1. The lime kiln 31 comprises a vessel 3, with a refractory lining 5 forming an inner wall 7, rotatable on rollers 9, the vessel having upper end wall 11 and lower end wall 13, with an inlet 15, calcining chamber 17 and outlet 19. Coal combustion products are charged to the calcining chamber 17 through combustion gas inlet 21, and gases from the vessel 3 are discharged through gas exhaust outlet 23.

At a predetermined location along said vessel, spaced from the combustion gas inlet 21, there is provided a means 33 for cooling the inner wall of the vessel. In the embodiment illustrated in Figure 2, the means 33 for cooling the inner wall of the vessel is an inwardly extending wall section 35 of the vessel 3, formed by side walls 37, outer wall 39 and inner wall 41 which extends radially inwardly into the refractory lining 5 and has means 43 for directing a cooling fluid through said inwardly directed wall section 35 exteriorly of the calcining chamber 15. The means for directing a cooling fluid through said inwardly directed wall section 35 is illustrated as coolant inlet 45 and coolant outlet 47 which communicate with a closed cooling chamber 49 formed by the outer wall 39, inner wall 41 and side walls 37.

Figure 4:
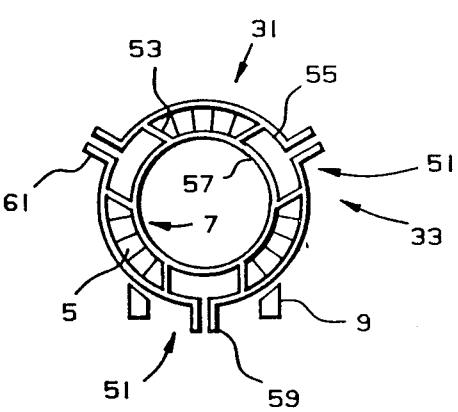
FIG. 4 is a cross-sectional view of another embodiment of the present invention wherein a plurality of spaced, diametrical cooling chambers are provided about the inner wall of the rotary vessel.

In the embodiment illustrated in FIG. 4, the means 33 for cooling the inner wall of the vessel comprises a plurality of spaced radially inwardly extending wall section 51 of the vessel 3, each of which are formed by side walls 53, outer wall 55 and inner wall 57, with respective inlet and outlet conduits 59 and 61 provided for each section, only one of each of which is shown.

Figure 5:
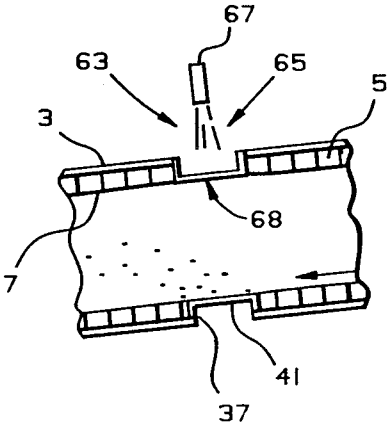
FIG. 5 is a cross-sectional view of a further embodiment of the present invention wherein a cooling channel is provided about the inner wall of the rotary vessel.

In the embodiment illustrated in FIG. 5, the outer wall 39 of the inwardly directed wall section of FIG. 2 has been removed, with a radially inwardly channel 63 formed by side walls 37 and inner wall 41. Cooling of such a channel can be provided merely by directing a fluid 65, such as water or air, against the inner wall 41, from an applicator, such as conduit 67, with the fluid cooling the same. While the drawing illustrates a conduit 67 for directing a flow of coolant against the inner wall 41 of the channel 63, other means for directing a coolant thereto could be used. For example, a scooping device could be used to transfer water from a reservoir to the channel, or other coolant directing means used.

The inner wall 41 of the cooling means may be of a metallic or ceramic material that will withstand the calcination temperatures that exist in the calcining chamber, or a layer or coating 68 (Figure 5) of a ceramic or refractory material may be placed on the surface thereof facing the calcining chamber so as to protect the same.

Figure 6:
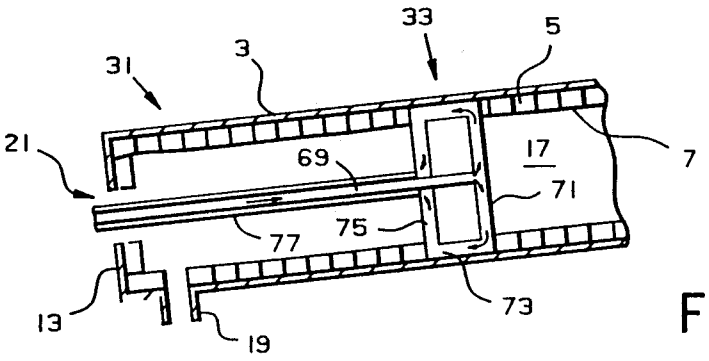
FIG. 6 is a cross-sectional view of an embodiment of the present invention wherein coolant is directed axially through the lower end wall of the rotary vessel into cooling conduits in the wall of the vessel.
Figure 7:
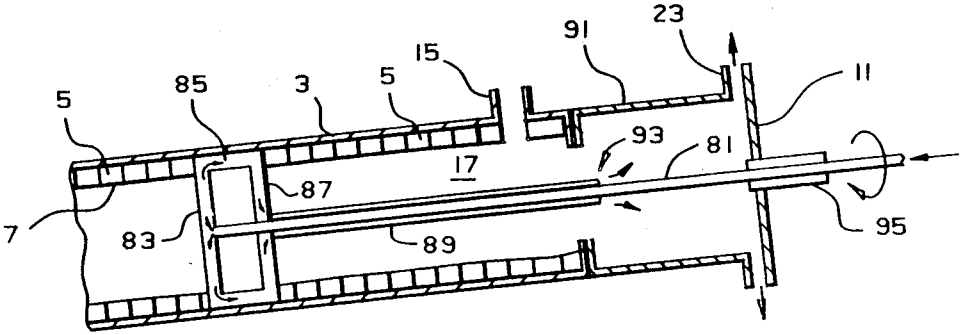
FIG. 7 is a cross-sectional view of another embodiment of the present invention wherein coolant is directed axially through the upper end wall of the rotary vessel into coolant conduits in the wall of the vessel and heated coolant discharged into the gases being exhausted from the vessel.

FIGS. 6 and 7 illustrate embodiments of the present invention wherein the cooling medium for the inner wall is directed coaxially within the vessel 3 and then radially outwardly to cool the inner wall 7. In FIG. 6, an inlet conduit 69 feeds coolant fluid from a force (not shown) axially from the lower end 13 of the vessel 3 to radially outwardly extending branch conduit 71 into wall section conduits 73 and then radially inwardly through inwardly extending branch conduits 75 to an outlet conduit 77 that is coaxially positioned relative to inlet conduit 69.

In FIG. 7, the cooling medium for the inner wall is charged through an inlet conduit 81 from a source (not shown) axially from the upper end 11, or exhaust gas discharge end, of the vessel, the coolant flowing through conduit 81 to radially outwardly extending branch conduits 83 into wall section conduits 85 and then radially inwardly through inwardly extending conduits 87 to an outlet conduit 89. The outlet conduit 89 teminates within the vessel exhaust section 91, at a location 93, spaced from the exhaust gas outlets 23 to spray heated coolant into the exhaust gas stream, cooling and cleaning the exhaust gas. A seal 95 is provided between the inlet conduit 81 and the end wall 11 of the rotary vessel 3.

Figure 8:
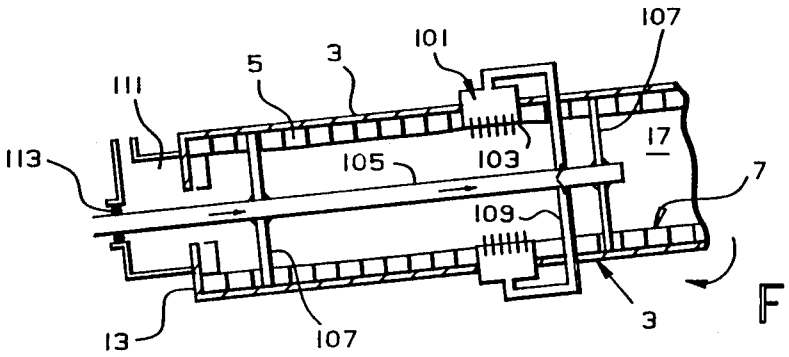
FIG. 8 is a cross-sectional view of an embodiment of the present invention wherein transpiration devices are present in the inner wall forming the calcining chamber and coolant fed coaxially through the lower end wall is dispersed therethrough into the calcining chamber.
Figure 9:
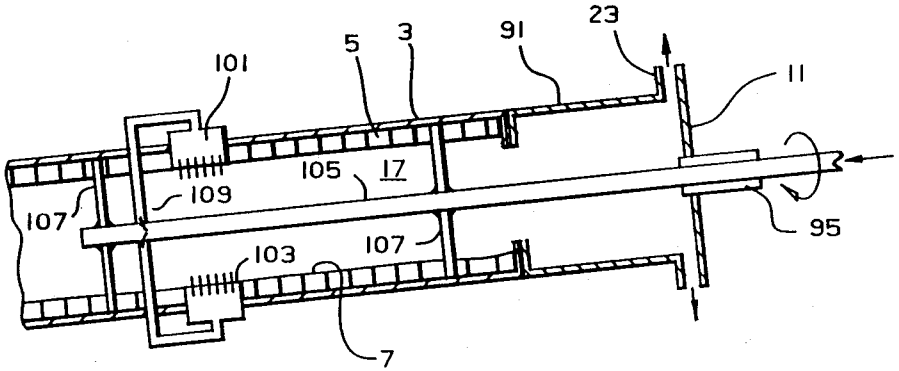
FIG. 9 is a cross-sectional view of another embodiment of the present invention wherein transpiration devices are present in the inner wall forming the calcining chamber, and coolant fed coaxially through the upper end wall is dispersed therethrough into the calcining chamber.

Embodiments of the present invention wherein transpiration devices are used to direct a coolant through the inner wall of the vessel into the calcining chamber 17 are illustrated in FIGS. 8 and 9. These transpiration devices, such as porous ceramic forms 101, which have a porous surface 103 facing the calcining chamber through which a cooling fluid may be injected, are inserted into the vessel 3 replacing selected portions of the refractory lining 5. In FIG. 8, a coolant is charged through axial inlet conduit 105, which is supported in the chamber 17 by use of radial struts 107, which contact the wall of the rotary vessel, and then outwardly through radially outwardly extending branch conduits 109 which communicate with the porous ceramic forms 101. The inlet conduit 105 extends through the lower wall 13 of the vessel and through a coal combustor 111 with a seal 113 provided in the wall of combustor 111 about the conduit.

The embodiment of the present invention schematically illustrated on FIG. 9 shows use of a transpiration device where the coolant is fed axially through the exhaust gas discharge end of the vessel. Porous ceramic forms 101, having porous surfaces 103 facing the calcining chamber, are inserted into the vessel replacing selected portions of the refractory lining 5. A coolant is charged through an axial inlet conduit 105, supported in the chamber 17 by radial struts 107. The coolant flows from inlet conduit 105 through radially outwardly extending branch conduits 109 which communicate with the porous ceramic forms 101. In this embodiment, the inlet conduit 105 extends through the upper wall 11 of the vessel, with a seal 95 provided about the conduit to seal the same relative to upper wall 11.

The method of the present invention enables the use of coal combustion products for the calcination of limestone to lime in a rotary kiln while retarding the formation of a slag ring about the inner wall of the kiln that normally forms the calcining chamber.

The terms lime and limestone, as used herein are meant to include not only calcium oxide and calcium carbonate but other calcium oxide and calcium carbonate containing mixtures of alkaline earth metal oxides and carbonates, such as dolomite, a mixture of calcium carbonate and magnesium carbonate, and the resulting oxide formed upon calcination thereof. The terms lime and limestone are used in the present specification, however, for the purpose of brevity.

According to the present method, the formation of a slag ring about the inner wall that forms a calcining chamber, where coal combustion products including dispersed molten slag are charged to the calcining chamber to provide heat for the calcination, is retarded by cooling the inner wall of a rotary kiln at a predetermined location spaced from the outlet end thereof. The predetermined location in the vessel, where dispersed molten slag would tend to contact the inner wall and form a slag ring is cooled to a temperature sufficient to cool the molten slag which is about to contact the wall so as to prevent adherence of the slag to the wall surface.

The predetermined location of the means 33 for cooling the inner wall of the vessel so as to retard formation of a solid residue slag ring may vary dependent upon the firing rate and the fusion temperature of the slag formed from a particular coal being combusted. The use of a plurality of means 33 spaced axially along the vessel is possible, as is the provision of an axially movable means 33 that could be mounted on a central shaft in the vessel, for example, to locate the cooling means at the predetermined location. The molten slag carried by the hot combustion gases, from coal combustion, tend to condense out of the slowly moving combustion gases as it loses its momentum. Such slag, if in a solid form, would mix with the charge passing through the rotary vessel and be discharged from the vessel with the lime produced. In prior methods of calcination in rotary kilns, the molten slag would contact the inner wall and solidify and eventually build up to form an effective dam to the charge of limestone and/or lime produced passing through the rotary vessel. In order for such a slag ring buildup to occur, some of the molten slag material must first attach to the inner wall as an anchor which then builds up to form a completely developed ring.

The temperature to which the slag must be cooled to prevent adherence thereof to the inner wall will vary dependent upon the coal being combusted, which will contain a particular ash composition. The slag formed is a mixture of components that will form a eutectic mixture that has an effect on the freezing temperature. Generally, however, the temperatures of molten slag formation from coal combustion, under reducing conditions, will be between about 2000° to 2600° F. (1110° to 1430° C.), with most such slags remaining wet or sticky above about 2600° F. and most such slags being solid or frangible below about 2000° F. The particular temperature to prevent adherence will then be within said temperature range and determinable by study of the particular ash control of the coating being combusted.

The present method, by cooling the molten slag, through cooling of the region of the wall where the slag would contact the wall, retards adhesion of the slag to the wall and any resultant slag ring. By cooling of the inner wall, the molten slag as it approaches the wall would start to solidify prior to contact with the inner wall as the vapor passes through the cool boundry layer, completely freezing as it contacts the cool surface of the wall, and spalling off due to differential thermal expansion. As discussed in connection with the description of the present apparatus, the inner wall may be cooled by directing a cooling fluid against the inner wall. The cooling fluid can comprise water, steam, air, or other coolant that would provide the degree of cooling necessary to prevent adherence of molten slag to the wall, and may be applied externally to the wall, or axially through the rotary vessel and outwardly to the wall to cool the same.

Where the coolant is passed axially through the calcining chamber and then to the wall section to be cooled, the resultant heated coolant, heated through indirect heat transfer by the hot combustion gases, can be discharged from the rotary vessel. Or, if desired, and as illustrated in FIG. 7, the heated coolant may be returned to the exhaust section of the rotary vessel, where the same is sprayed into the hot combustion gas stream, cooling and cleaning the exhaust gases prior to discharge from the rotary vessel.

The inner wall may also be cooled by the use of transpiration devices, as shown in FIGS. 8 and 9. In such a method, air, water or steam would be dispersed through transpiration devices in the inner wall of the rotary vessel, with the cooling fluid injected into the calcining chamber through a transpiration device such as a porous ceramic form having a porous surface, facing the calcining chamber, through which the coolant is dispersed. Such a porous form may be comprised of a ceramic, cermet, or a high temperature compatible metal alloy.

The present invention provides for cooling of a predetermined wall section of a rotary lime kiln vessel wall which should freeze the molten slag that is carried into the calcining chamber as it approaches the inner wall forming the calcining chamber, to prevent attachment of the slag to the inner wall. This would retard the formation of a slag ring in the rotary vessel and the advantages associated with retardation of formation of such a ring.

What is claimed is:

1. In a rotary kiln for the calcination of limestone to form lime, having a refractory lined inner wall forming a calcining chamber, and an inlet end for limestone and an outlet end for lime formed therein, where a coal combustion chamber is provided adjacent the outlet end, with hot combustion gases and dispersed molten slag formed in the combustion chamber entering the kiln adjacent the outlet end thereof for countercurrent flow through said kiln relative to the limestone charged and lime produced; and wherein said dispersed molten slag enters the rotary kiln, and contacts the inner wall at a predetermined location spaced from the outlet end and solidifies thereon and tends to form a solid residue slag ring; the improvement wherein a means for cooling said inner wall is provided at said predetermined location spaced from the outlet end so as to cool said dispersed molten slag prior to contact thereof with said inner wall whereby said dispersed molten slag is cooled sufficiently, prior to contact with said inner wall, so as to retard formation of said solid residue slag ring on said inner wall.

2. The rotary kiln as defined in claim 1 wherein a plurality of spaced radially inwardly wall sections are provided diametrically about said rotary kiln.

3. The rotary kiln as defined in claim 2 wherein each of said plurality of wall sections has closed inner, outer, and side walls to form a cooling chambers, and means are provided to charge cool fluid to each said cooling chamber and remove fluid heated by said calcining chamber from each said cooling chamber.

4. The rotary kiln as defined in claim 1 wherein said means for cooling said inner wall comprises an inlet conduit coaxially positioned within said calcining chamber, radially outwardly extending branch conduits, wall section conduits, radially inwardly extending conduits, an outlet conduit coaxially positioned in said calcining chamber, and means for charging cooling fluid to said inlet conduit and means for discharging cooling fluid after passage through said inlet conduit, radially outwardly extending conduit, wall section conduits, radially inwardly extending conduits and said discharge conduit.

5. The rotary kiln as defined in claim 4 wherein said inlet conduit extends through the said outlet end of said rotary kiln.

6. The rotary kiln as defined in claim 4 wherein said inlet conduit extends through the inlet end of said rotary kiln.

7. The rotary kiln as defined in claim 6 wherein a vessel exhaust section is provided in said rotary kiln, adjacent said inlet end, having an exhaust gas outlet and said discharge conduit terminates within said vessel exhaust section.

8. The rotary kiln as defined in claim 1 wherein said cooling means comprises a radially inwardly extending wall section on said rotary kiln extending into said refractory lining, and means for directing a cooling fluid through said radially inwardly extending wall section exteriorly of said calcining chamber, to cool said radially inwardly extending wall section.

9. The rotary kiln as defined in claim 8 wherein said radially inwardly extending wall section extends completely around said rotary kiln.

10. The rotary kiln as defined in claim 8 wherein said radially inwardly directed wall section has closed inner, outer, and side walls to form a cooling chamber, and means are provided to charge cool fluid to said cooling chamber and remove fluid heated by said calcining chamber from said cooling chamber.

11. The rotary kiln as defined in claim 8 wherein said cooling fluid comprises water.

12. The rotary kiln as defined in claim 8 wherein said cooling fluid is air.

13. The rotary kiln as defined in claim 1 wherein said means for cooling comprise transpiration devices in the form of porous forms having porous surfaces facing said calcining chamber and means for injecting coolant fluid through said porous surfaces.

14. The rotary kiln as defined in claim 13 wherein said means for injecting coolant fluid through said porous surfaces comprise an inlet conduit coaxially positioned in said calcining chamber, radially outwardly extending branch conduits communicating with said porous forms, and means for changing a coolant fluid to said inlet conduit.

15. The rotary kiln as defined in claim 14 wherein said inlet conduit extends through said outlet end of said rotary kiln.

16. The rotary kiln as defined in claim 14 wherein said inlet conduit extends through said inlet end of said rotary kiln.

17. A method of retarding the formation of a solid residue ring on the inner wall of a rotary calcining lime kiln having an inlet end for limestone and an outlet end for lime formed therein, during the calcination of limestone to form lime, wherein heat is applied to said kiln by combustion of coal, which produces hot combustion gases and dispersed molten slag that are charged to the calcining chamber of said kiln adjacent the outlet end thereof, for countercurrent flow through said kiln relative to the limestone charged and lime produced, comprising:

cooling the inner wall of said rotary kiln at a predetermined location spaced from the outlet where said dispersed molten slag tends to form said solid slag residue ring, so as to cool said dispersed molten slag prior to contact thereof with said inner wall sufficiently to retard formation of said solid residue ring on said inner wall.

18. The method as defined in claim 17 wherein said cooling of the inner wall is effected by injecting a cooling fluid through porous forms into said calcining chamber.

19. The method as defined in claim 17 wherein said cooling of the inner wall is effected by directing a cooling fluid against said inner wall.

20. The method as defined in claim 19 wherein said coling fluid is water.

21. The method as defined in claim 19 wherein said cooling fluid is air.

22. The method as defined in claim 19 wherein said cooling fluid is directed against said inner wall externally of said calcining chamber.

23. The method as defined in claim 19 wherein said cooling fluid is directed coaxially through said calcining chamber and outwardly to said inner wall.

24. The method as defined in claim 23 wherein said cooling fluid is directed through the outlet end of said rotary kiln.

25. The method as defined in claim 23 wherein said cooling fluid is directed through the inlet end of said rotary kiln.

26. The method as defined in claim 25 wherein said cooling fluid, after being directed against said inner wall is discharged into said hot combustion gases adjacent said outlet end of the kiln.

* * * * *